US005898968A

United States Patent [19]

Beattie

[11] Patent Number: 5,898,968

[45] Date of Patent: May 4, 1999

[54] ACCESSORY FOR CLEANING GOLF CLUB HEADS AND GOLF BALLS

[76] Inventor: Bruce E. Beattie, 636 Pelican Bay Dr., Daytona Beach, Fla. 32119

[21] Appl. No.: 08/902,627

[22] Filed: Jul. 29, 1997

[51] Int. Cl.[6] ..... A63B 47/04; A63B 57/00; A47L 25/00

[52] U.S. Cl. ..... 15/210.1; 150/160; 206/315.2; 206/315.9; 221/64; 224/919; 383/41; 383/67

[58] Field of Search ..... 15/209.1, 210.1, 15/21.2; 150/160; 206/315.2, 315.4, 315.9; 221/64, 65, 267, 307; 224/918, 919; 383/23, 41, 67, 117

[56] References Cited

U.S. PATENT DOCUMENTS

| | | | |
|---|---|---|---|
| 1,737,065 | 11/1929 | Thornton | 383/117 X |
| 2,493,681 | 1/1950 | Mayer et al. | 15/21.2 X |
| 3,806,983 | 4/1974 | Cunningham et al. | 15/21.2 X |
| 3,938,570 | 2/1976 | Stewart | 150/160 |
| 4,416,404 | 11/1983 | Daniels | 206/315.9 X |
| 4,516,616 | 5/1985 | Fesler | 150/154 |
| 5,075,918 | 12/1991 | Zeltner et al. | 15/210.1 |
| 5,131,112 | 7/1992 | Cervini | 15/209.1 |
| 5,146,968 | 9/1992 | Meek | 150/160 |
| 5,372,414 | 12/1994 | Lamonakis et al. | 312/3 |
| 5,394,914 | 3/1995 | Meek | 150/160 |
| 5,451,108 | 9/1995 | Anderson | 383/41 X |
| 5,641,103 | 6/1997 | Potik et al. | 224/918 X |

FOREIGN PATENT DOCUMENTS

| | | | |
|---|---|---|---|
| 201266 | 8/1923 | United Kingdom . | |
| 258417 | 9/1926 | United Kingdom . | |
| 2264691 | 9/1993 | United Kingdom | 221/64 |

*Primary Examiner*—Mark Spisich
*Attorney, Agent, or Firm*—Bergert & Bergert

[57] ABSTRACT

A device for cleaning and drying golf club heads and for cleaning, drying, and carrying golf balls can be secured to the user during play. The device includes a generally pliant, hollow sleeve member having a large opening at its upper end and a smaller opening at its lower end. The upper and lower openings of the sleeve member are appropriately sized to allow golf club heads of any size to be cleaned within the sleeve upper interior portion while golf balls may be cleaned within the sleeve lower interior portion. Additionally, the appropriately sized lower opening permits golf balls to be retained within the lower interior portion of the sleeve member and squeezed out as needed. The device accomplishes all of the cleaning of the golf equipment internally and therefore prevents any cleaned off material from contacting the user or the user's clothing.

24 Claims, 3 Drawing Sheets

ACCESSORY FOR CLEANING GOLF CLUB HEADS AND GOLF BALLS

BACKGROUND OF THE INVENTION

1. Field of the Invention

The present invention relates to golf accessories, and more particularly to a device which can be worn on the user during play and which can be used to carry, clean, and dry golf balls as well as to clean and dry golf club heads.

2. Description of the Related Art

For most golfers, clean and dry golf clubs and golf balls are imperative for optimum play. Unfortunately, in the course of playing a round of golf, the typical golfer will soil his or her golf club heads and golf balls quite frequently. To combat this nuisance, most golfers carry a golf towel secured to their golf bag or placed in their golf cart. When the head of a golf club becomes dirtied or wet, the golfer can bring the club over to the towel and wipe the club head clean. Golf balls may be cleaned and dried in the same manner or by using one of the available golf ball cleaners which are usually found sporadically placed along the typical golf course.

The drawbacks to this mode of cleaning and drying balls and club heads are numerous. For instance, golf ball cleaners are not always readily available and it is often inconvenient to either hand carry a standard golf towel or retreat to a golf bag or cart to clean a club or ball. Further, while securing a towel to the golfer's clothing may lessen this inconvenience, the golfer's clothing will eventually become wet or dirty through contact with the progressively soiled towel. Additionally, since most golfers carry one or more golf balls in their pockets during play, if a golf ball is not cleaned before being placed in the pocket, the golfer's pocket will become dirty.

There is therefore a need for a device which allows a golfer to conveniently maintain clean and dry golf balls and golf club heads throughout a round of golf at any place on the golf course regardless of course or weather conditions and which will further help prevent any cleaned off matter from contacting the golfer or the golfer's clothing.

Previous devices related to golf club and/or golf ball cleaners are described, for example, in Great Britain Patent Nos. 201,266 to Randell and 258,417 to Wilkins as well as in the following U.S. Pat. Nos.: 3,938,570 to Stewart; 4,516,616 to Fesler; 5,075,918 to Zeltner et al.; 5,131,112 to Cervini; 5,146,968 to Meek; 5,372,414 to Lamonakis et al.; and 5,394,914 to Meek.

None of the devices shown in the above patents discloses a device for cleaning and drying golf club heads and golf balls according to the present invention wherein the device can be worn by the golfer and used in such a manner that the golfer and the golfer's clothing are not soiled by any cleaned off matter.

It is thus one object of the present invention to provide a device which allows a golfer to conveniently maintain clean and dry golf balls and golf club heads throughout a round of golf at any place on the golf course regardless of course or weather conditions.

It is another object of the present invention to provide a device for cleaning and drying golf club heads and golf balls which may be worn by the user during the course of play and which will help prevent the user and the user's clothing from contacting any cleaned off matter.

It is a further object of the present invention to provide a device for cleaning and drying golf club heads and golf balls which can be worn during the course of play and which can store several golf balls at a time.

It is yet another object of the present invention to provide a device for cleaning and drying golf club heads and golf balls which is easily maintained such as by washing.

SUMMARY OF THE INVENTION

By the present invention, there is provided a device for cleaning and drying golf club heads and golf balls as well as for carrying golf balls during the course of play. The device includes a generally pliant, hollow sleeve member having a large opening at its upper end and a smaller opening at its lower end. The device may be made of a resilient fabric material such as terry cloth, for example, and can be worn by the user during play without obstructing the user's swing or other general movement. The upper and lower openings of the sleeve member are appropriately sized to allow golf club heads of any size to be cleaned within the sleeve upper interior portion while golf balls may be cleaned within the sleeve lower interior portion. This prevents the device from becoming oversoiled in any one interior area. The sleeve member also includes an overlapping cuff portion which allows the user to securely grip the club head to be cleaned without soiling his or her hand. Additionally, the appropriately sized lower opening permits golf balls to be retained within the lower interior portion of the sleeve member and squeezed out when needed.

The device accomplishes all of the cleaning of the golf equipment internally and therefore prevents any cleaned off material from contacting the user or the user's clothing. Thus, the device of the present invention provides an easy-to-use, conveniently accessible cleaner for golf club heads and golf balls which can also be used to store golf balls during a round of play.

DETAILED DESCRIPTION OF THE PREFERRED EMBODIMENTS

Figure 1:
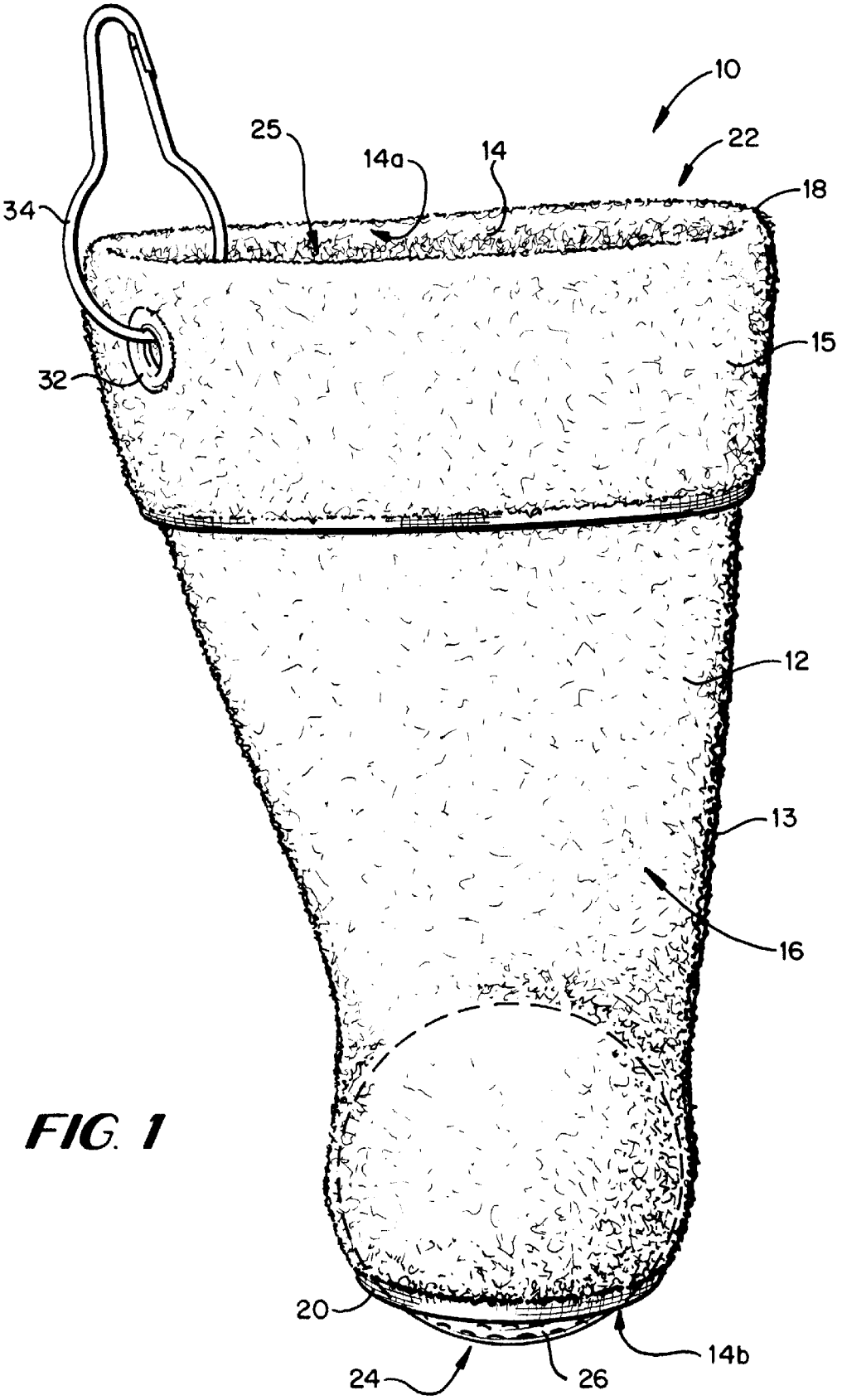
FIG. 1 is a perspective view of the device of the present invention, showing a golf ball in the lower interior portion.
Figure 5:
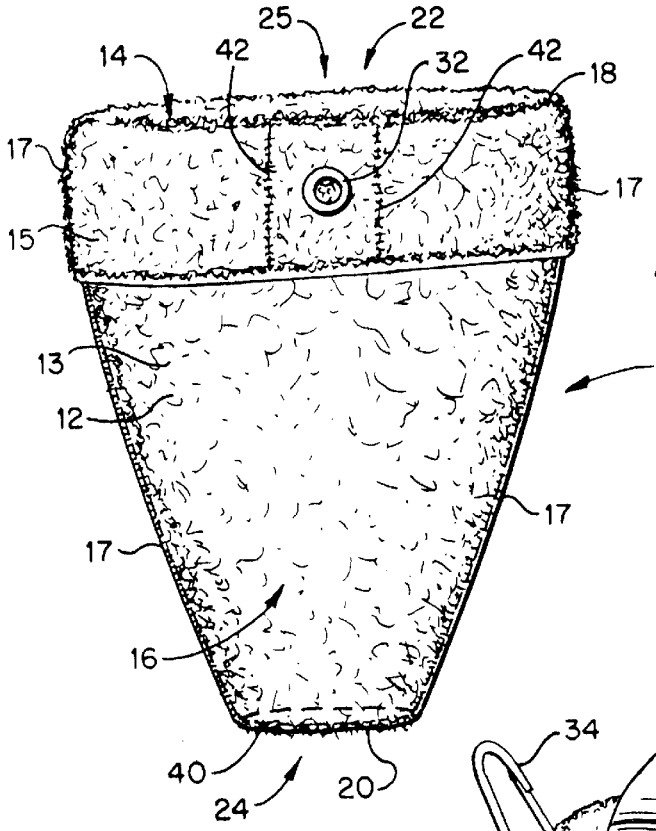
FIG. 5 is a perspective view of one embodiment of the device of the present invention.
Figure 2:
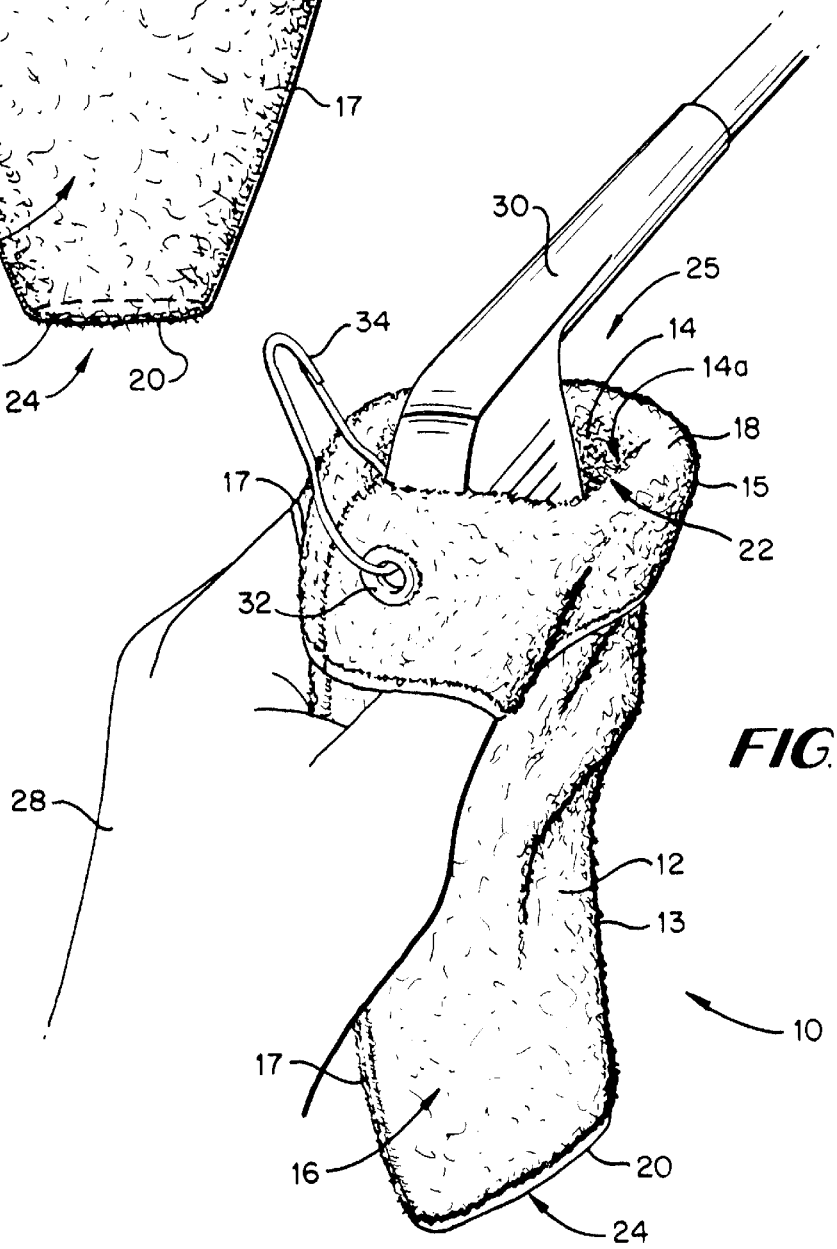
FIG. 2 is a perspective view of the device of the present invention, showing a golf club head being cleaned within the upper interior portion.
Figure 3:
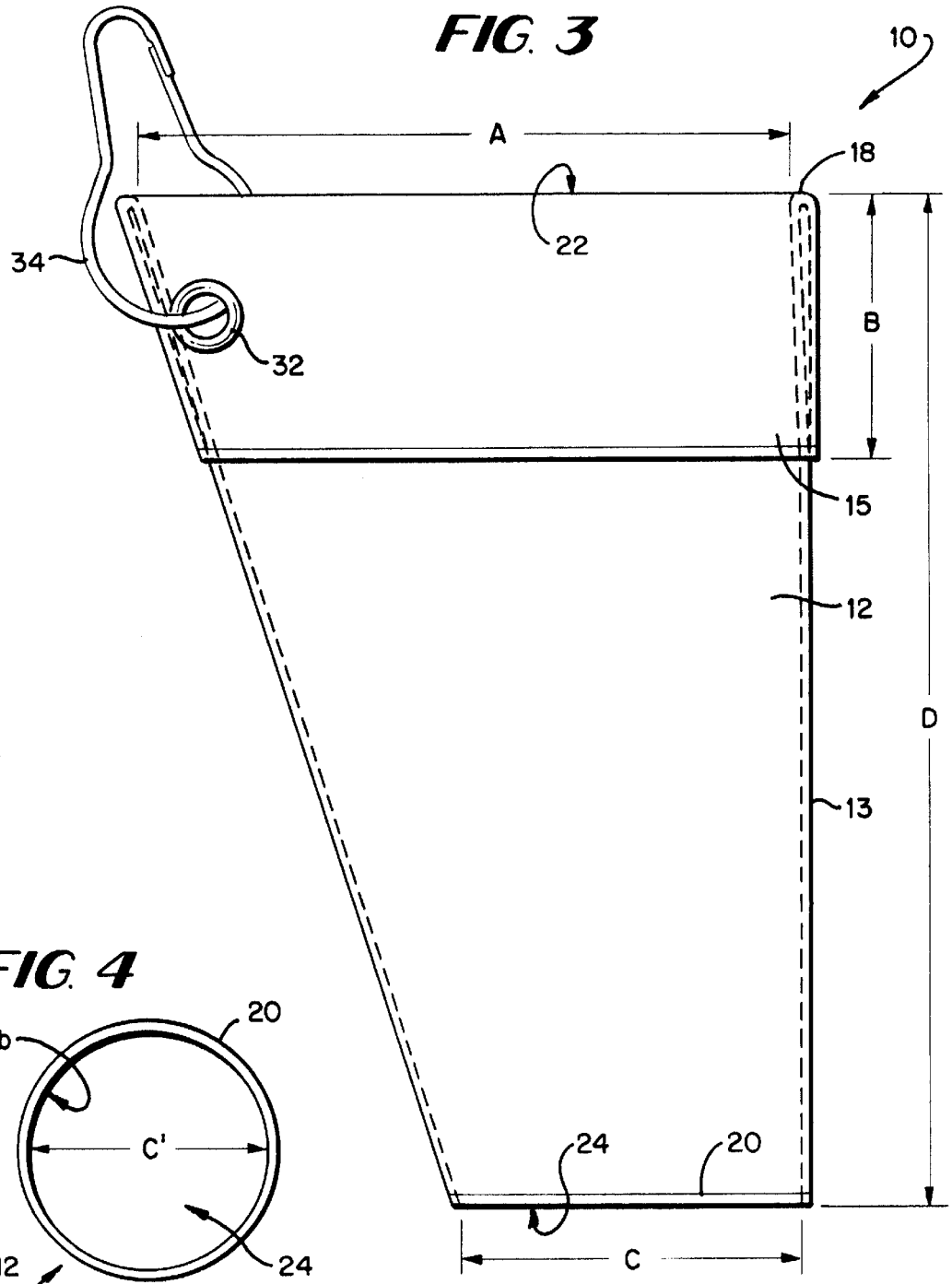
FIG. 3 is a front elevation of the device of the present invention, shown in the substantially flat position.

In the embodiment of the invention as shown in FIGS. 1 through 5, there is provided a device 10 for cleaning and drying golf club heads as well as for cleaning, drying, and carrying golf balls. The device 10 includes a generally pliant hollow. sleeve member 12 formed of a water absorbent, resilient fabric material such as cotton or cotton-blend terry cloth, for example. The device may optionally be formed of a plastic or other material which is lined with terry cloth or may be formed of a lightweight disposable paper material. In one embodiment of the invention, as shown in FIGS. 1 through 3, the device is formed of a single piece of fabric material having four sides wherein one side of the material is folded over to form a cuff 15 and wherein the two opposing sides adjacent the cuff are sewn together along a seam 17 to provide the sleeve member with a hollow shape. In another embodiment of the invention, as shown in FIG. 5, the sleeve member is formed of a pair of matching four-sided pieces of fabric material which are placed together, folded over to form a cuff, and sewn together with seams 17 along their mating side edges. For aesthetic purposes, the sleeve member may be sewn so as to have an internal seam, such as by inverting the sleeve member prior to sewing.

The sleeve member 12 can assume a substantially frustoconical shape, as shown in FIGS. 1 and 5, and at rest can assume a substantially flat shape, as represented in FIG. 3. The sleeve member embodiment formed of two pieces is substantially symmetrical, as shown in FIG. 5.

As shown in FIGS. 1 through 5, the sleeve member 12 has a body portion 13 and an overlapping cuff portion 15. The sleeve member body portion 13 has an interior 14 and an exterior 16 surface and has upper 18 and lower 20 rims which define, respectively, upper 22 and lower 24 openings in the sleeve member. The upper opening 22 is larger in size than the lower opening 24. An internal passageway 25, as shown in FIGS. 1 and 2, extends axially through the sleeve member body portion 13 so as to allow fluid communication between the upper opening 22 and the lower opening 24. When substantially flat, as represented in FIG. 3, the sleeve member tapers from a maximum internal width A at the upper rim 18 to a minimum internal width C at the lower rim 20.

As shown in FIGS. 1 and 2, upper opening 22 is sufficiently large to allow golf club heads 30 and golf balls 26 to be inserted. The size of the upper opening 22 and the pliant nature of the sleeve member 12 allow any golf club head which meets the current size standards of the United States Golf Association to be easily inserted through the upper opening 22 for cleaning and drying. This includes golf club heads ranging from potters and irons to oversized woods and drivers. The size of the upper opening 22 can be defined by the upper rim internal width A, which is measured when the sleeve member 12 is substantially flat as represented in FIG. 3. In one embodiment of the invention, upper rim 18 has an internal width A from approximately four inches to approximately seven inches. In a specific embodiment of the invention, upper rim 18 has an internal width A of approximately 4.25 inches.

The overlapping cuff portion 15 acts to strengthen the sleeve along the upper rim 18 so that-the user may easily insert the golf club equipment to be cleaned without having to hold the sleeve member open. Additionally, as shown in FIG. 2, the overlapping cuff portion 15 helps shield the user's hand 28 from dirt or other matter as it grips the club head 30 to be cleaned. The cuff portion 15 extends from the sleeve member upper rim 18 downwardly about the exterior 16 of the sleeve member body portion 13 and has a width B, as shown in FIG. 3, which can range from approximately one to four inches. In one embodiment of the invention, the cuff portion 15 has a width B of approximately 1.75 inches. The sleeve member body 13 or cuff 15 portion may optionally be embroidered for personalizing the device or denoting corporate sponsorship, for example.

As shown in FIGS. 2 and 5, the cuff portion 15 is secured to the sleeve body portion 13 by one or more sleeve seams 17. Securing the cuff portion to the body portion helps prevent the cuff portion 15 from sliding up and down the sleeve body portion 13 during use, which can reduce the device's effectiveness in shielding the user's hand and in maintaining any cleaned off material within the upper interior portion 14*a* of the sleeve. Additionally, a grommet 32 is secured to the cuff portion 15 and the body portion 13 to allow quick and easy attachment of the device to-the user's belt loop, for example, using a clip member 34 such as that shown in FIGS. 1 through 3. In the sleeve member embodiment formed of two pieces, shown in FIG. 5, the grommet 32 is secured substantially equidistant from each sleeve seam 17 so as to assist in biasing the upper rim 18 in an open position when the device is suspended from the user. The upper rim 18 becomes biased open because the cuff portion is heaviest at the sleeve seams 17. Thus, suspending the device from the grommet located between the seams will result in the seams and the cuff portion being pulled by gravity into the open position.

Figure 4:
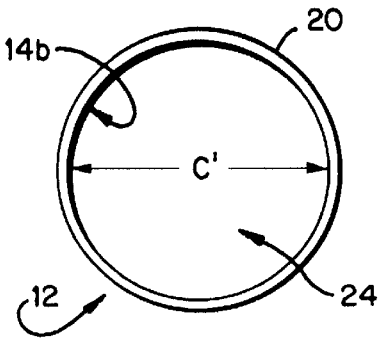
FIG. 4 is a bottom plan view of the lower rim of the device of the present invention, showing the lower rim in circular orientation.

As shown in FIG. 1, when a golf ball 26 has been placed in the sleeve member 12, it passes through the internal passageway 25 to the sleeve lower interior portion 14*b*, thereby causing the lower rim 20 to assume a generally circular shape having internal diameter C', shown in FIG. 4. Internal diameter C' is of sufficient size to allow the sleeve lower rim 20 to retain one or more golf balls securely in the lower interior portion 14*b* of the sleeve 12 without allowing the ball or balls to naturally fall out. In this way, the sleeve 12 acts as a pocket to maintain one or more golf balls 26 during the round, as shown in FIG. 1.

The sleeve member 12 is sufficiently flexible to allow lower rim 20 to slightly expand, such that the lower rim internal diameter C' can become of sufficient size to allow a standard size golf ball to be gently squeezed out by manual pressure through the lower opening 24 of the sleeve 12. In one embodiment of the invention, sleeve lower rim 20 is elasticized. In another embodiment of the invention, as shown in FIG. 5, the sleeve member 12 may be provided with a lower rim seam 40 extending around the lower rim 20 for reinforcement. Due to the tight tolerance of the sleeve lower rim 20 and the resulting high frictional engagement of the golf ball with the sleeve member lower interior portion 14*b* as the golf ball. passes through the lower opening, the golf ball will be cleaned as it is squeezed through the lower opening. Thus, the golf ball. is retained within the internal passageway 25, as if in a pocket, until such time as it is needed, whereupon a gentle downward pressure applied to the sleeve exterior 16 at a location just above the ball will at once clean and expel the ball from the sleeve member.

In one embodiment of the present invention, the ratio of the lower rim internal diameter C' to the diameter of a standard size golf ball is from approximately 0.75:1.00 to approximately 1.01:1.00. This means that, for this embodiment, the lower rim internal diameter C' ranges from approximately 75% to 101% that of the standard golf ball during the course of conveying a standard size golf ball through the lower opening. In this embodiment, the internal width C of lower rim 20, as measured when the sleeve member is substantially flat as shown in FIG. 3, will be from approximately 0.375 to approximately 0.50 the circumference of a standard size golf ball. In a specific embodiment of the invention, lower rim 20 has an internal width C of approximately two inches.

The above defined ranges may be greater or smaller depending upon such factors as the type of material used and variations in the size or weight of a standard golf ball, for example. The standard size golf ball diameter is currently approximately 1.680 inches, according to the 1997 Rules of Golf as published by the United States Golf Association.

The sleeve member 12 is of sufficient height D, as shown in FIG. 3, to allow the user to retain several balls within the sleeve during play without losing them through the upper rim opening 22. As golf balls are placed within the sleeve, they stack up over the lower rim opening 24. In one embodiment of the invention, the sleeve height D can be from approximately two inches to approximately nine inches. In a specific embodiment of the present invention, the sleeve height D is approximately 7.5 inches.

In using the device of the present invention to clean or dry golf equipment, the device is preferably secured to the user in a freely hanging position, such as depending from the user's belt loop, for example. The device may be hung from the user's golf bag, if desired, although such use would negate the convenience available by wearing the device. The freely hanging position facilitates ball movement towards the lower opening, as desired, and allows the user to maintain free hands. In cleaning or drying a golf ball, for example, the user drops the ball in the upper rim opening 22, lets it fall to the lower interior portion 14*b* of the sleeve 12, and massages the ball from the sleeve exterior 16 in such a way as to eject the ball through the lower rim opening 24 as heretofore described. In this way, any cleaned off matter remains within the sleeve member lower interior portion 14*b* and does not contact the user or the user's clothing. If the golf ball is not to be used immediately, the sleeve member will act as a pocket to retain the ball within the internal passageway 25. The ball may optionally be cleaned in a manner which will not expel the ball through the lower opening.

To clean or dry a golf club head, the user places the golf club head to be cleaned through the upper opening 22, then cleans the club by positioning one hand underneath the overlapping cuff portion 15, as shown in FIG. 2, and massaging the club head 30 with the upper interior portion 14*a* of the sleeve member. In this way, the user's hands remain clean and any cleaned off matter remains within the upper interior portion 14*a* of the sleeve member. In one embodiment of the present invention, as shown in FIG. 5, a pair of cuff seams 42 are placed on opposite sides of and adjacent the grommet 32 so as to protect the sleeve material around the grommet as well as to provide thumb pockets for simpler manipulation of the device in cleaning club heads.

Any sizable matter cleaned off of the golf club head or golf ball, such as clumps of dirt, may naturally fall through the m sleeve lower opening during the course of use. The device also discourages overuse of any particular portion of the sleeve member interior by channeling balls to be cleaned to the lower interior portion 14*b* and allowing golf club heads to be cleaned only within the upper interior portion 14*a*. At the end of a round of play, the device may be washed and dried as an ordinary article of clothing so as to be ready for reuse.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A device for cleaning golf club heads and for cleaning and temporarily storing golf balls, comprising:

a generally pliant hollow sleeve member having an upper and lower rim, said upper and lower rims defining a respective upper and lower opening, said sleeve member having a substantially frustoconical shape and having an internal passageway extending axially therethrough so as to allow fluid communication between said upper and lower openings, said sleeve member being capable of assuming a substantially flat position wherein said sleeve member has a first internal width at said upper rim and a second internal width at said lower rim, said first internal width being larger than said second internal width, said sleeve member upper opening being of sufficient size to receive at least one standard size golf ball which, upon moving within said internal passageway towards said lower opening, will result in said lower rim assuming a generally circular shape wherein said lower rim has an internal diameter which is slightly smaller than the diameter of a standard size golf ball so as to retain said at least one golf ball within said sleeve member for cleaning and temporarily storing said at least one golf ball, said lower rim being capable of slight expansion so as to allow said lower rim internal diameter to increase to a size slightly greater than the diameter of a standard size golf ball whereby a user may expel said at least one golf ball through said lower opening, said sleeve member upper opening also being of sufficient size to receive a golf club head, whereby a user may clean said golf club head within said sleeve member; and, means for releasably securing said sleeve member to a support wherein said securing means engages said sleeve member at a discrete point adjacent said sleeve upper rim.

2. The device of claim 1 wherein said sleeve member tapers from a maximum internal width at said upper rim to a minimum internal width at said lower rim.

3. The device of claim 1 wherein said releasably securing means includes a grommet secured within said sleeve member and a clip member, freely secured within said grommet.

4. The device of claim 1 wherein the ratio of said lower rim internal diameter to the diameter of a standard size golf ball is from approximately 0.75:1 to approximately 1.01:1.

5. The device of claim 1 wherein said second width of said sleeve member is from approximately 0.375 to approximately 0.50 the circumference of a standard size golf ball.

6. The device of claim 1 wherein said first internal width is from approximately four inches to approximately seven inches.

7. The device of claim 1 wherein said sleeve member has a height which is in the range of approximately two inches to approximately nine inches.

8. The device of claim 1 wherein said sleeve member lower rim is elasticized.

9. The device of claim 1 wherein said sleeve member includes a seam extending around said lower rim.

10. The device of claim 1 wherein said sleeve member is of a resilient fabric material.

11. The device of claim 10 wherein the resilient fabric material is terry cloth.

12. The device of claim 1 wherein said sleeve member upper opening is of sufficient size to receive a typical golf club iron head.

13. The device of claim 1 wherein said sleeve member upper opening is of sufficient size to receive an oversized driver head.

14. A device for cleaning golf club heads and for cleaning and temporarily storing golf balls, comprising:

a generally pliant hollow sleeve member having a body portion and an overlapping cuff portion, said body portion having an exterior and further having an upper and lower rim, said overlapping cuff portion extending from said upper rim downwardly about said sleeve member body portion exterior, said upper and lower rims defining a respective upper and lower opening, said sleeve member having an internal passageway extending axially therethrough so as to allow fluid communication between said upper and lower openings, said sleeve member being capable of assuming a substantially flat position wherein said sleeve member has a first internal width at said upper rim and a second internal width at said lower rim, said first internal width being larger than said second internal width, said sleeve member upper opening being of sufficient size to receive at least one standard size golf ball which, upon moving within said internal passageway towards said lower opening, will result in said lower rim assuming a generally circular shape wherein said lower rim has an internal diameter which is slightly smaller than the diameter of a standard size golf ball so as to retain said at least one golf ball within said sleeve member for cleaning and temporarily storing said at least one golf ball, said lower rim being capable of slight expansion so as to allow said lower rim internal diameter to increase to a size slightly greater than the diameter of a standard size golf ball whereby a user may expel said at least one golf ball through said lower opening, said sleeve member upper opening also being of sufficient size to receive a golf club head whereby a user may clean said golf club head within said sleeve member.

15. The device of claim 14 wherein said sleeve member tapers from a maximum internal width at said upper rim to a minimum internal width at said lower rim.

16. The device of claim 14 further including means for releasably securing said sleeve member to a user.

17. The device of claim 16 wherein said releasably securing means includes a grommet secured to said sleeve member body portion and to said cuff portion and further includes a clip member freely secured within said grommet.

18. The device of claim 17 wherein said sleeve member is formed of a pair of mating sleeve pieces secured together by a pair of sleeve seams and wherein said grommet is secured approximately equidistant from each seam.

19. The device of claim 18 wherein said sleeve member includes a pair of cuff seams securing said cuff portion to said body portion, said cuff seams being located on opposite sides of and adjacent to said grommet.

20. The device of claim 14 wherein the ratio of said lower rim internal diameter to the diameter of a standard golf ball is from approximately 0.75:1 to approximately 1.01:1.

21. The device of claim 14 wherein said first internal width is from approximately four inches to approximately seven inches.

22. The device of claim 14 wherein said sleeve member has a height which is from approximately two inches to approximately nine inches.

23. The device of claim 14 wherein said sleeve member lower rim is elasticized.

24. The device of claim 14 wherein said sleeve member includes a seam extending around said lower rim.

* * * * *